United States Patent [19]

Hester et al.

[11] 4,361,271

[45] Nov. 30, 1982

[54] MAIL BOX CONVERSION KIT

[76] Inventors: Jay L. Hester, 3459 Rainey Ave., Hapeville, Ga. 30354; Irving P. Banks, 12635 Zimmer Dr., NE., Atlanta, Ga. 30306

[21] Appl. No.: 182,523

[22] Filed: Aug. 29, 1980

[51] Int. Cl.[3] ..... A47G 29/12

[52] U.S. Cl. ..... 232/17; 232/33; 232/24

[58] Field of Search ..... 232/17, 35, 34, 24, 232/33

[56] References Cited

U.S. PATENT DOCUMENTS

| | | | |
|---|---|---|---|
| 916,766 | 3/1909 | Norgord | 232/24 |
| 1,595,284 | 8/1926 | Bergman | 232/24 |
| 2,801,046 | 7/1957 | Mirkin | 232/34 |
| 2,945,621 | 7/1960 | Kopprasch et al. | 232/24 |
| 3,758,027 | 9/1973 | Morgan | 232/17 |

FOREIGN PATENT DOCUMENTS

| | | | |
|---|---|---|---|
| 652003 | 12/1964 | Belgium | 232/17 |
| 587039 | 2/1975 | Switzerland | 232/24 |
| 570143 | 12/1975 | Switzerland | 232/17 |

*Primary Examiner*—Roy D. Frazier
*Assistant Examiner*—Peter A. Aschenbrenner

[57] ABSTRACT

A kit for a traditional rural mail box into which mail is usually delivered through an opening in the front of the box, to convert such a mail box into one having two separate compartments, one of which is secured by a lock and into which mail may be placed through a slot and the other of which is open in the usual way, for reception of newspapers, periodicals and other mail whose contents is not of such value as to require secure delivery.

2 Claims, 3 Drawing Figures

MAIL BOX CONVERSION KIT

This invention relates to a kit for converting present or existing rural type mail boxes into security mail boxes in which mail which is to be specially protected is secured in a locked compartment of the mail box separately from advertising, periodicals and other ordinary mail.

More particularly it relates to means for converting a traditional rural mail box having a single mail receiving interior into a mail box divided into two compartments, an upper compartment provided with a lock to enhance the security of the mail delivered to said compartment and a lower compartment into which ordinary mail or parcels may be placed by the postman.

With the recent advent of social programs and the spread of pension systems, many elderly persons receive pension checks, welfare checks and other mail necessary to their well being on a biweekly, monthly or even weekly basis. Such mail has become the target of thieves and other individuals seeking to appropriate such checks to their own use and many addressees attempt to forestall this by meeting the mailman and having the mail delivered to them personally. When the weather is inclement or the mailman is delayed or is ahead of schedule, this is not always possible.

One object of this invention is to provide a kit to enable people to convert their present or existing traditional rural type mail box into a security mail box.

Another object of the invention is a mail box which has been converted to a security mail box by the installation of said kit.

Still a further object of the invention is to improve the security of the delivery of mail to addressees as compared with the security of mail placed in the normal rural mail box.

These and other objects will become apparent from the description which follows taken in conjunction with the drawings in which.

Figure 1:
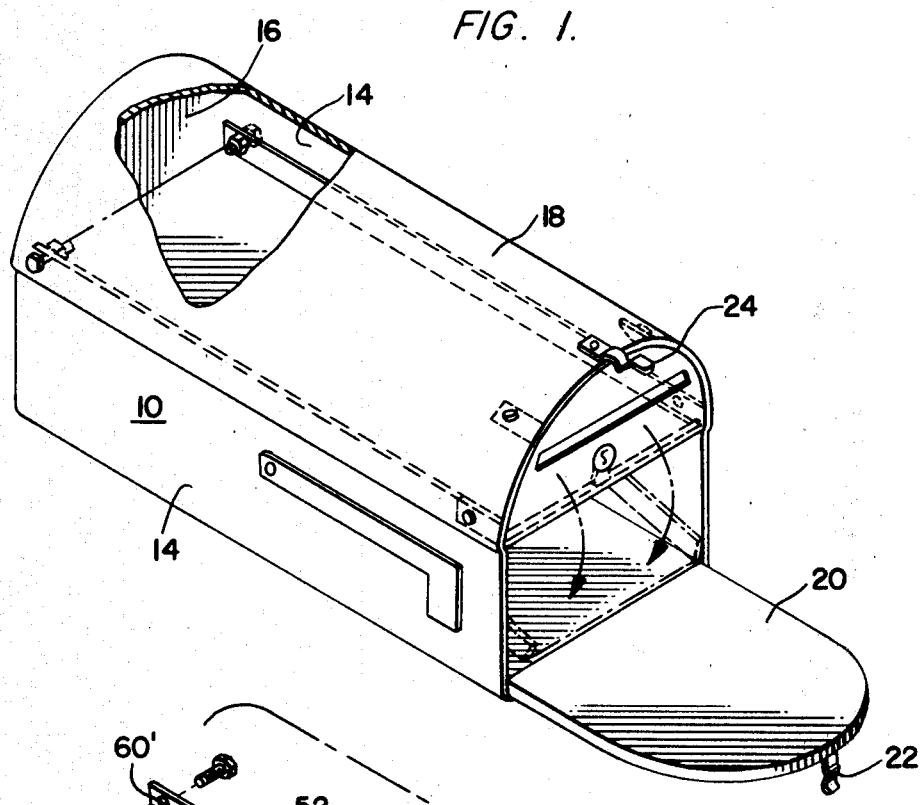
FIG. 1 is a view in perspective of a traditional rural mail box as modified by the present invention.

FIG. 1 shows a traditional mail box 10 comprising a generally rectangular lower box portion defined by a floor 12, side walls 14 and a back wall 16, covered by an arched roof 18 and closed by a hinged front door 20, carrying a latch 22 which cooperates with a strip of metal 24 carried by the roof 18 and extending from said roof. All of the above are conventional and form no part of the present invention which is directed to a kit for converting said mail box to a secured mail delivery box.

The mail box conversion kit of the present invention includes the following elements:

1. a front panel piece contoured to fit snugly against the roof of the traditional rural mail box;
2. a tray to constitute the floor of the secured compartment;
3. means for mounting the tray so that it can be pivoted to deliver the mail from the upper and secure compartment; and
4. bolts, screws and other fitting required for assembly of the above parts, to the mail box being converted.

Figure 2:
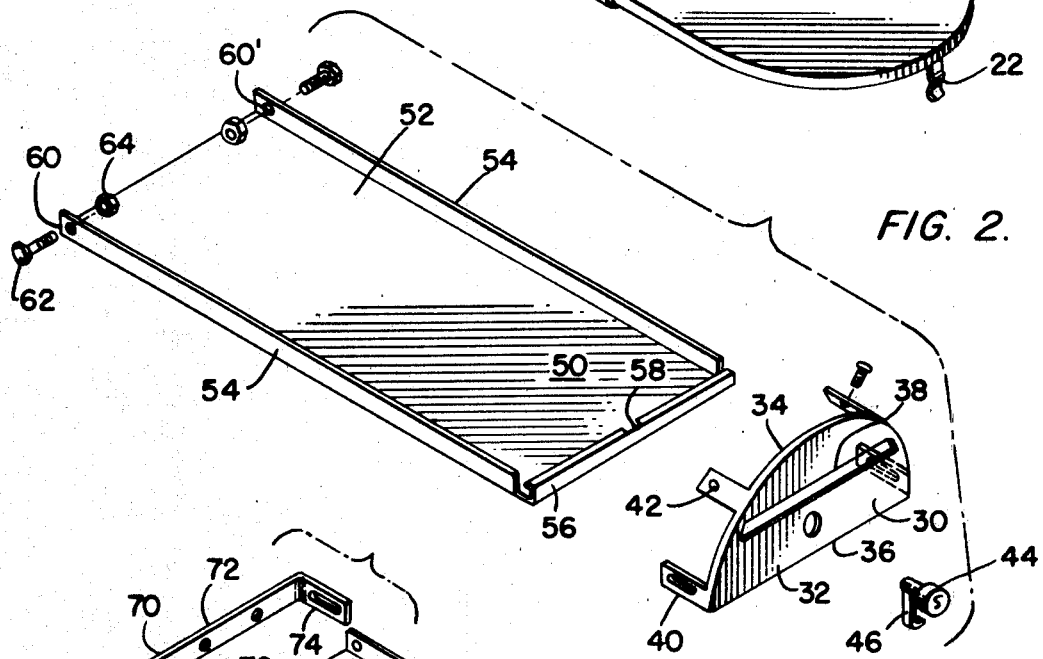
FIG. 2 is an exploded view in perspective showing the components of the kit comprising the present invention.

As seen in FIG. 2, the front panel piece 30 consists of a metal plate 32 having a top 34 shaped complementary to the roof of the mail box, e.g. arched or hemispherical and a straight base 36. A slot 38 extends across the upper part of the plate and is dimensioned to receive letters for secured delivery. The front panel piece includes tabs 40 which are bent from plate 32 so as to extend rearwardly from the front panel piece, each tab being provided with an opening 42 for the reception of screws or other means to secure the front panel piece to the walls of the existing mail box as shown in the broken lines in FIG. 1. At least some of the openings 42 may be elongated to facilitate positioning of the front panel piece within the mail box and clear of the usual front door 20 which closes the traditional mail box. A lock 44 and locking arm 46 are installed in the front panel piece and cooperate with a mail tray 50 to permit the compartment defined by the roof, tray, back wall and front panel to be securely locked.

The mail tray 50 which constitutes the floor of the secured compartment of the mail box shown in FIG. 1 consists of a plate 52 having sides 54 which are preferably bent up along the length of the tray and a flange 56 bent up along the front edge of the tray 50. Flange 56 is provided with a slot 58 to receive locking arm 46 when a key is inserted into lock 40 and is turned to lock the upper compartment behind the panel 30. The tray 50 is provided with holes 60, 60' to receive bolts 62 to mount the tray so that it can be pivotted about an axis passing through holes 60. Instead of bolts 62 and nuts 64 a rod extending through holes 60, 60' may be used as the means to mount and pivot tray 50.

Figure 3:
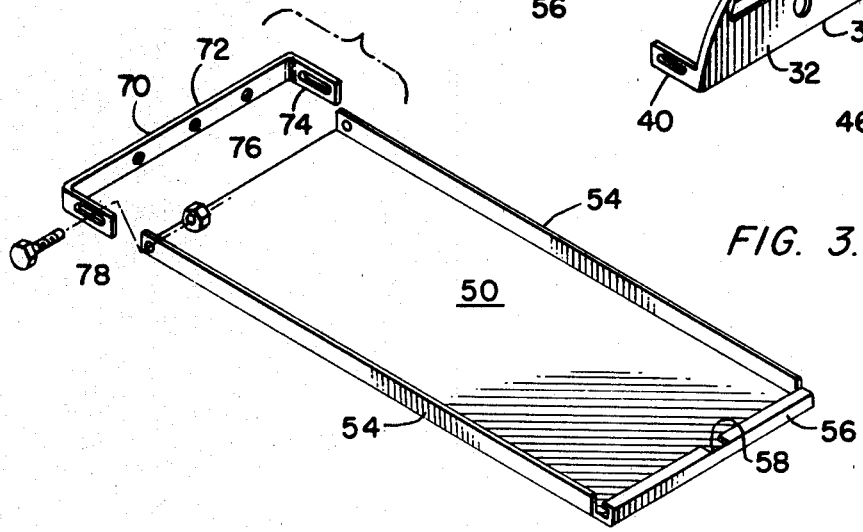
FIG. 3 is an exploded view in perspective of a modification of FIG. 2.

A further modification is shown in FIG. 3 wherein tray 50 is supported by a bracket 70 which can be attached to the rear wall 16 of the traditional mail box.

The mounting bracket 70 as shown in FIG. 3 consists of a metal strip 72, the ends of which are bent to form wings 74 at right angles to the plane of strip 70. The body of the strip is provided with holes or slots 76 for receiving screws to attach the bracket 70 to the back wall (or to a side wall) of the mail box and wings 74 are provided with apertures 78 for receiving fasteners to secure brackets 70 and tray 50 to the traditional mail box so as to provide a floor for the secure compartment.

It will be apparent that by suitable modification the tray could be made to pivot about an axis extending longitudinally of the mail box instead of transversely as shown in the drawings, but such an arrangement is less preferable than one in which the tray pivots about the shorter transverse axis.

The front panel piece is installed in the upper compartment about one half inch from the front of the box. The bottom of the front panel piece can be moved in or out for locking adjustments.

The mail tray is mounted near the back of the box on the same level as the bottom of the front panel piece. The tray is horizontal and is supported by means of pivot bolts extending through the sides of the box. A spacer and bushing (not shown) are slipped on the pivot bolt so that bushing will extend through pivot holes in the tray to enhance the support of said tray.

The back pivot bracket may be used to mount the mail tray instead of the pivot bolts through the side of the box. The bracket is mounted in the back of the box with three screws. The mail tray is connected to the bracket with pivot bolts through pivot holes in the tray and through pivot holes in the tray and through pivot and adjusting slots on the bracket.

When the mail tray is installed, it is lifted into locked position and any adjustments needed are made. When the box is unlocked, the front of the tray will drop giving access to the contents in the upper part of the box.

The kit does not change the outside appearance of a mail box. When the mail box door is closed there is nothing visible to indicate that this is a security box. The kit is inexpensive and is readily installed using conventional fastenings, such as sheet metal screws.

Having described the invention in accordance with the patent statutes it is not intended that it be limited except as required by the appended claims.

I claim:

1. A kit for converting a traditional rural mail box into a mail box divided into two separate compartments, one of which is secured by a lock for the reception of valuable mail and into which mail may be placed through a slot and the other of which is open in the usual way, which comprises:

a front panel piece comprising a metal plate having a top shaped complementary to the roof of the mail box and configured to fit snugly into the upper roof portion of the front opening of a mail box, and having a straight base, there being a mail receiving slot extending across the upper part of said front panel piece, tabs on said front panel piece extending rearwardly from said front panel piece, said tabs being provided with apertures to receive means to secure said panel piece to said mail box at its front end, and an aperture in said panel piece provided to receive a lock;

a lock to be installed in said aperture in said front panel piece;

means to secure the tabs on said front panel piece to the roof of said mail box;

a tray which constitutes the floor of the secured compartment and which is disposed horizontally in said mail box and which extends from a location adjacent to the bottom of said front panel piece, to the rear wall of said mail box, said tray having upstanding sides which extend lengthwise of said tray, there being a flange at the front end of said tray;

a U-shaped bracket adapted to be secured to the back of the mail box and having wings for attachment of said tray to said mail box and a bolt passing through the bracket wings and the upstanding sides of the tray in a manner which permits the tray to be pivoted about the axis of the bolt so as to permit said secured compartment to be emptied of its contents.

2. The kit of claim 1 in which the tray has a flange on its front end to cooperate with the lock on said front panel piece.

* * * * *